United States Patent [19]

Ramsay et al.

[11] 4,363,130

[45] Dec. 7, 1982

[54] BINARY DIGITAL COMMUNICATION SYSTEM

[75] Inventors: William R. Ramsay, Mt. View; James J. Spilker, Jr., Palo Alto, both of Calif.

[73] Assignee: Lockheed Missiles & Space Company, Inc., Sunnyvale, Calif.

[21] Appl. No.: 16,099

[22] Filed: Mar. 18, 1960

[51] Int. Cl.³ ..... H04K 1/00

[52] U.S. Cl. ..... 455/27; 455/26; 375/2.1; 332/9 R

[58] Field of Search ..... 250/6.6, 6.4; 332/68, 332/9 R; 178/22; 375/2.1, 23, 58; 455/26, 27, 29, 59, 101; 329/145; 179/15.55 T

[56] References Cited

U.S. PATENT DOCUMENTS

| | | | |
|---|---|---|---|
| 2,091,271 | 8/1937 | Conklin . | |
| 2,530,140 | 11/1950 | Atkinson | 375/2.1 |
| 2,565,504 | 8/1951 | Labin et al. | 375/23 |
| 2,829,346 | 4/1958 | Hughes et al. | 332/9 R |
| 2,923,882 | 2/1960 | Bradford | 332/23 |
| 2,972,046 | 2/1961 | Seaton | 332/68 |
| 3,150,374 | 9/1964 | Sunstein et al. | 179/15.55 T |

FOREIGN PATENT DOCUMENTS 663511 8/1938 Fed. Rep. of Germany .

*Primary Examiner*—Howard A. Birmiel
*Attorney, Agent, or Firm*—John J. Morrissey

EXEMPLARY CLAIM

1. A binary digital communication system comprising a transmitter and receiver: said transmitter comprising means for alternately radiating in response to the digits of a binary message two signals of non-periodic energy which have been delayed by a predetermined amount with respect to one another, and means for phase shifting one of said signals by 180° prior to radiation thereof in response to one of the "0" and "1" digits of the binary message; said receiver comprising means for receiving the signals alternately radiated by said transmitter, means for delaying the alternately received signals with respect to one another so they are brought back into correlation, and correlation-sensitive means to which the correlated received signals are fed, the output of said correlation-sensitive means being representative of said binary message.

5 Claims, 2 Drawing Figures

BINARY DIGITAL COMMUNICATION SYSTEM

This invention relates generally to means and methods for transmitting and receiving digital information, and more particularly to improved means and methods for transmitting and receiving binary digital information employing non-periodic energy as the transmission carrier.

With the increasing use of digital computers and systems, the transmission and reception of digital information has taken on new importance. Of course, conventional communication system are available for transmitting digital information, but the use of such conventional systems is somewhat inefficient and wasteful, since the digital information to be transmitted is of relatively simple form and should not require the complexities of conventional communication systems. Besides, it is often necessary to transmit large amounts of digital information requiring many communications systems and/or channels, so that the use of conventional communication systems involves not only considerable circuitry, but very considerable expense. The problem is further complicated where secrecy, a high immunity to jamming and freedom from doppler effects are required of the system, as in certain military applications.

In recent years, efforts have been directed towards devising simplified digital communication systems which take advantage of the digital form of the information. However, the systems which have so far been devised do not offer any great simplification over conventional communication systems and have not appreciably reduced the complexity and expense involved in digital transmitting and receiving systems. Also, these systems do not offer any real secrecy or a high immunity to jamming.

Accordingly, it is the broad object of this invention to provide improved means and methods for transmitting and receiving digital information.

A more specific object of this invention is to provide simplified means and methods for transmitting and receiving binary digital information by the use of non-periodic energy as the transmission carrier signal.

An additional object of this invention is to provide improved means and methods for transmitting and receiving binary digital information so that a high immunity to jamming and a significant measure of secrecy is achieved.

Another object of this invention is to provide improved means and methods for transmitting and receiving binary digital information which is unaffected by doppler.

A further object of this invention is to provide improved means and methods for transmitting and receiving binary digital information which permit the use of random energy as the transmission carrier signal.

Still another object of this invention is to provide a binary digital transmitting and receiving system which is capable of operating even in the presence of large amounts of interfering noise.

Yet another object of this invention is to provide improved means and methods for transmitting and receiving binary digital information in a manner in which more efficient use is made of transmission time.

An additional object of this invention is to provide the improved means and methods of the aforementioned objects in relatively simple and compact form.

In a typical embodiment of the invention the output from a relatively wide band random source is divided into two correlated signals, one signal being delayed by a predetermined amount with respect to the other. Electronic switching means are then provided for alternately radiating the undelayed and delayed signals for equal periods of time, the sum of these periods being equal to the repetition rate of the pulses corresponding to the binary message. The binary information is then introduced by inverting (that is, shifting by 180°) the delayed signal with respect to the undelayed signal for each "0" of the binary message, and maintaining the delayed signal in phase with the undelayed signal for each "1" of the binary message. At the receiver the received signals corresponding to the undelayed and delayed signals are brought to the same time basis, compared in a multiplier and then integrated. After integration a positive signal is obtained for in-phase correlated signals, a negative signal is obtained for 180° out-of-phase correlated signals, and substantially no signal is obtained for uncorrelated signals. Thus, positive output pulses are obtained for each "1" of the binary message and negative pulses are obtained for each "0" of the binary message, thereby reproducing the binary message at the receiver.

The specific nature of the invention, as well as other objects, uses and advantages thereof, will clearly appear from the following description and from the accompanying drawing in which.

Like numerals designate like elements throughout the figures of the drawing.

Figure 1:
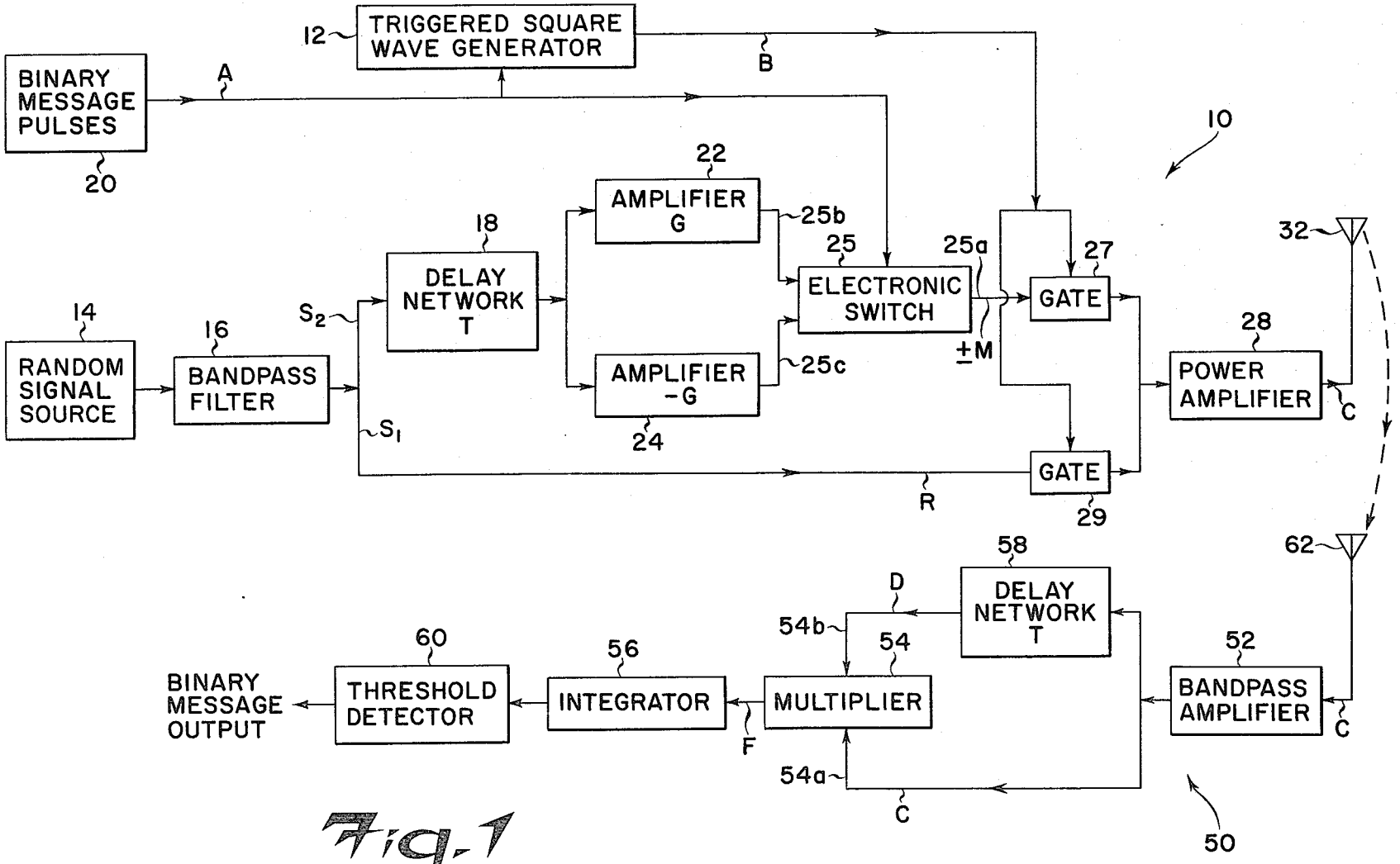
FIG. 1 is a block diagram of an embodiment of a binary digital transmitting and receiving system, in accordance with the invention.

In FIG. 1, a transmitter 10 and a receiver 50 of a binary digital transmitting and receiving system is shown. In the transmitter 10, a random signal source 14 provides a random signal over a wide frequency band, which may be derived either from energy occurring naturally or from random energy generated in a conventional manner, such as by using amplified thermal, shot or other available noise sources. Also, the random signal source 14 may provide a semi-random signal obtained by introducing noise into a periodic signal by such means as noises modulation.

The non-periodic signal obtained from the random signal source 14 may be spread over a wide band and it is often desirable to restrict its bandwidth to a predetermined band of frequencies. This is accomplished by feeding the output of the source 14 to a bandpass filter 16 having a predetermined center frequency and bandwidth. The bandwidth provided by the bandpass filter 16 is preferably relatively wide as compared to conventional communication channels employing periodic signals. The use of a wide bandwidth is desirable in achieving a good signal-to-noise ratio and reducing the possibility of jamming, as will hereinafter become evident.

The output from the bandpass filter 16 is divided into two signals $S_1$ and $S_2$. The signal $S_1$ is fed to a power amplifier 28 through a gate 29. The other signal $S_2$ is fed to a delay network 18 providing a delay equal to T seconds. The delayed signal obtained from the delay network 18 is then fed to the inputs of the amplifiers 22 and 24, the amplifier 22 providing a gain of G, and the amplifier 24 providing a gain of −G as shown in FIG.

1. The designations of the gains G and −G for the amplifiers 22 and 24 are for the purpose of indicating that the outputs from these amplifiers 22 and 24 are of the same magnitude, but inverted with respect to each other, that is, they are 180° out of phase These 180° out-of-phase outputs from the amplifiers 22 and 24 are then fed to the fixed contacts 25*b* and 25*c*, respectively, of a single-pole, double-throw electronic switch 25 adapted to pass only the output from one of the amplifiers 22 and 24 to the movable contact 25*a* thereof at any one time. That is, when the electronic switch 25 is in one position, the terminals 25*a* and 25*b* will be closed and the terminals 25*a* and 25*c* open; and when the electronic switch 25 is in the other position the terminals 25*a* and 25*c* will be closed and the terminals 25*a* and 25*b* open. The particular one of the outputs of the amplifiers 22 and 24 which passes to the movable contact 25*a* is then fed to a power amplifier 28 through a gate 27.

The switch position of the electronic switch 25 is controlled by the polarity of the binary message pulses 20 fed thereto and representing the binary message which is to be transmitted to the receiver 50. These binary message pulses 20 consist of positive and negative pulses having a repetition rate equal to 1/2T, where T is the same as the time delay provided by the delay network 18; each positive pulse corresponds to a "1" of the binary message, and each negative pulse corresponds to a "0" of the binary message. The conversion of a binary message into such positive and negative pulses can readily be accomplished in a variety of well known ways, and the block 20 in FIG. 1 is intended to represent the necessary structure for this purpose.

The electronic switch 25 is adapted to cooperate with the positive and negative binary message pulses 20 so that when a binary message pulse is positive corresponding to a "1" of the binary message, the electronic switch 25 will be in a position (hereinafter referred to as position 1) such that its contacts 25*a* and 25*b* are closed and its contacts 25*a* and 25*c* open; and when the binary message pulse is negative corresponding to a "0" of the binary message, the electronic switch 25 will be in a position (hereinafter referred to as position 2) such that its contacts 25*a* and 25*c* are closed and its contacts 25*a* and 25*b* open. Consequently, the signal passed to the contact 25*a* for a "0" of the binary message will be the negative (that is, shifted by 180°) from the signal passed to the contact 25*a* for a "1" of the binary message.

It will now be evident that the two signals $S_1$ and $S_2$ into which the output of the bandpass filter 16 is divided are eventually fed to the gates 27 and 29, the signal $S_1$ being fed directly to the gate 29 and the signal $S_2$ being fed to the gate 27 after first being delayed by an amount T, and being shifted in phase by 180° for a "0" of the binary message, while remaining in phase with the signal $S_1$ for a "1" of the binary message. The signal $S_1$ fed to the gate 29 will hereinafter be referred to as a reference signal R and the delayed signal $S_2$ fed to the gate 27 will be referred to as a message signal M, a 180° shifted message signal being referred to as −M. These signals R and ±M appearing at the inputs to the gates 27 and 29, respectively, are now alternately fed to the power amplifier 28 for equal time periods of T seconds as a result of the alternate operation of the gates 27 and 29 as will now be described.

The opening of the gates 27 and 29 is controlled by the signal output from a triggered square wave generator 12 which is triggered by the binary message pulses 20. The triggered square wave generator 12 is adapted to produce a square wave consisting of a positive pulse followed by a negative pulse of equal duration equal to T seconds in response to each pulse of the binary message pulses, whether positive or negative. When there are no binary message pulses present to trigger the square wave generator 12, no output is obtained therefrom.

The gate 27 is designed so that it is opened only for the duration of the positive output pulse from the triggered square wave generator 12, while the gate 29 is designed so that it is opened only for the duration of the negative output pulse from the triggered square wave generator 12. Thus, the gates 27 and 29 in cooperation with the triggered square wave generator 12 and the binary message pulses 20 act to cause the signals applied to the power amplifier 28 and radiated from the antenna 32 to alternate between the reference signal R and the message signal ±M, the time duration of each signal being equal to T seconds.

Figure 2:
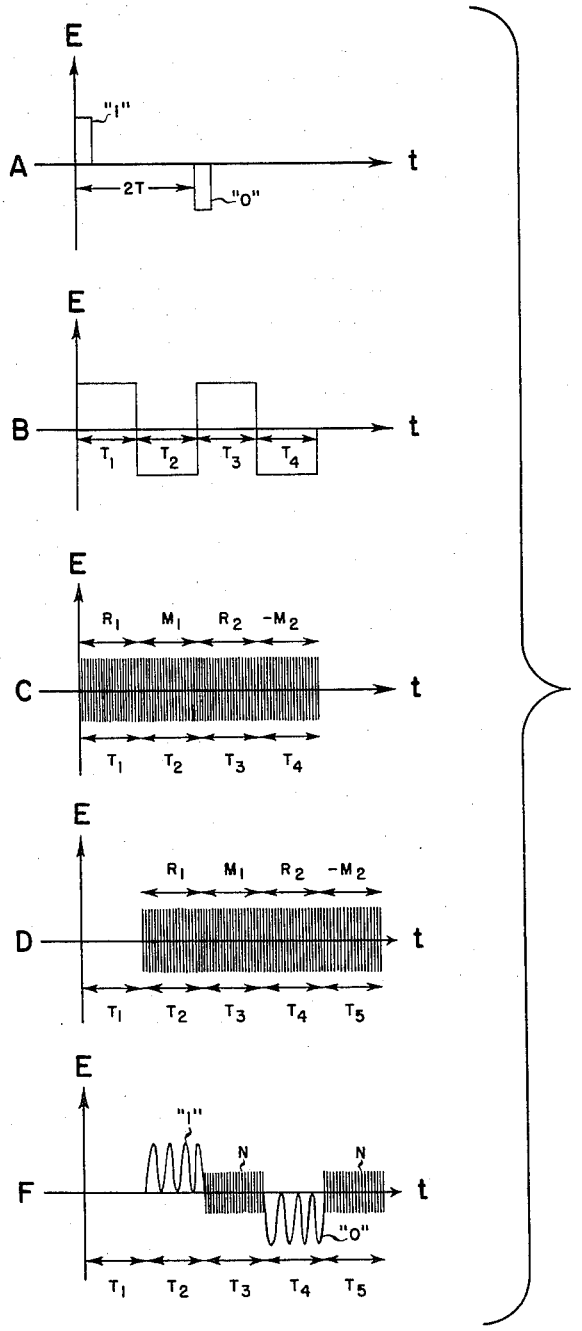
FIG. 2 is a series of graphs illustrating the signals appearing at various points in the system of FIG. 1.

Now referring to FIG. 2 which illustrates graphs corresponding to similarly designates points in the block diagram of FIG. 1, it will be understood that graph A illustrates the type of binary message pulses 20 of repetition rate 2T which may be employed, the positive pulse "1" in the graph A corresponding to a "1" of the binary message and the negative pulse "0" corresponding to a "0" of the binary message. Only two pulses are shown in the graph A, but it will be evident that the description contained herein applies in a like manner to any number of pulses which may be employed.

Graph B of FIG. 2 illustrates the output obtained from the triggered square wave generator 12. It can be seen from graph B that in response to each binary message pulse of graph A, the triggered square wave generator 12 produces a positive pulse of duration T, followed by a negative pulse of the same duration T. The designations $T_1$, $T_2$, $T_3$, $T_4$ and $T_5$ in the graphs indicate successive equal periods of time T.

Graph C illustrates the resultant signal radiated from the antenna 32 as a result of the previously described operation of the system of FIG. 1. Assuming for eplanatory purposes that the positive and negative pulses "1" and "0" of graph A represent a complete binary message, then the output of the triggered square wave generator 12 will be as shown in graph B for the intervals $T_1$, $T_2$, $T_3$ and $T_4$. Thus, during the intervals $T_1$ and $T_3$ the gate 29 will be open, and for the intervals $T_2$ and $T_4$ the gate 27 will be open. Also, because the first pulse "1" of the binary message is positive, the electronic switch will be in position 1 during the intervals $T_1$ and $T_2$; and because the second pulse "0" of the binary message is negative, the electronic switch 25 will be in position 2 during the intervals $T_3$ and $T_4$.

It now follows, as shown in graph C, that during the interval T, a reference signal $R_1$ is radiated, and during the interval $T_2$ a message signal M is radiated which is in phase with the reference signal $R_1$ and delayed therefrom by an amount T. Similarly, during the interval $T_3$ a reference signal $R_2$ is radiated, and during the interval $T_4$ a message signal $-M_2$ is radiated which is 180° out of phase with the reference signal $R_2$. Because of the random nature of the signal obtained from the random signal source 14, successive pulses of the reference signal such as $R_1$ and $R_2$, or successive pulses of the message signal $M_1$ and $-M_2$ are uncorrelated. It will be understood, therefore, that the signal radiated from the transmitter 10 appears as nothing more than a continuous signal of random energy, and an unwanted listener who does not know the principle of operation and/or the delay T will be unable to interpret it.

At the receiver 50, the antenna 62 picks up the signal radiated from the transmitter 10 (as shown in graph C of FIG. 2) and feeds it to a bandpass amplifier 52 having a bandwidth which is preferably only large enough to receive the band of the radiated signal. The output of the bandpass amplifier 52 is divided into two portions, one portion being fed directly to one input 54*a* of a multiplier 54 and the other portion being fed through a delay network 58 to the other input 54*b* of the multiplier 54. The delay network 58 is chosen to provide the same delay T as the delay network 18 in the transmitter 10.

Referring to the graphs C and D of FIG. 2, it will now be understood that the signal applied to the input 54*a* of the multiplier 54 will be that shown in graph C, while the signal applied to the input 54*b* of the multiplier 54 will be that shown in graph D, which is the signal of graph C delayed by T as a result of passing through the delay network 58. The output of the multiplier 54 is fed to an integrator 56 for integration thereof.

The action of the multiplier 54 is such that when in-phase correlated signals are simultaneously applied to its inputs 54*a* and 54*b*, a positive signal will be produced at its output, and when 180° out-of-phase correlated signals are simultaneously applied a negative signal is produced at the multiplier output. On the other hand, uncorrelated signals applied to the multiplier 54 produce an output therefrom which tends to integrate out to zero. Typical types of multipliers which may be used as the multiplier 54 in FIG. 1 are described in "Modulation Theory" by H. S. Block, pp. 145–148, and "Communication Theory" by W. Jackson, pp. 200–202.

Referring to the graphs C and D of FIG. 2, it will now be understood that during the time interval $T_1$, the in-phase correlated message and reference signals $R_1$ and $M_1$ are simultaneously applied to the multiplier 54 so as to produce a positive output from the multiplier 54 as illustrated by "1" in graph F of FIG. 2; and during the interval $T_4$ the 180° out-of-phase correlated message and reference signals $R_2$ and $-M_2$ are simultaneously applied to the multiplier 54 so as to produce a negative output from the multiplier 54 as illustrated by "0" in graph F. During the intervals $T_3$ and $T_5$ correlated signals do not appear at the inputs to the multiplier 54 so that only a noise signal is obtained at the output from the multiplier as illustrated by N in graph F. It should be remembered that because the message and reference signals are derived from the output of the random signal source 14, successive portions of each will be uncorrelated. Thus, signals such as $M_1$ and $R_2$ which are simultaneously applied to the multiplier 54 are uncorrelated and produce only a noise signal such as indicated at N in graph F.

In the integrator 56, noise signals such as N in graph F appearing at the multiplier output tend to integrate out to zero. Consequently, at the output of the integrator 56, the positive and negative pulses respectively corresponding to "1" and "0" of the binary message are easily recognizable, even in the presence of large amounts of interfering noise.

The output from the integrator 56 may now be fed to any suitable type of threshold detector 60 to produce positive and negative pulses of suitable amplitude and duration of application to computer circuitry. For example, a limiter type of threshold detector 60 could be provided which produces a positive pulse when the output from the integrator 56 is greater than a positive threshold value, and a negative pulse when the output from the integrator 56 is greater than a negative threshold value.

The integrator 56 should be designed so that it is capable of recovering in the interval T between the positive and negative output signals obtained from the multiplier 54 corresponding to a binary message. For the particular binary message of graph A of FIG. 2, this would mean that in the interval $T_3$ after integration of the "1" pulse (graph F) the integrator 28 should recover sufficiently to be able to satisfactorily integrate the "0" pulse. Such integrators can readily be provided by those skilled in the field.

From the above description of the invention, various important features of the system will now become evident. First, as mentioned previously, because detection is obtained by multiplying correlated pulses and then integrating, detection of these pulses is possible even in the presence of large amounts of interfering noise, since uncorrelated signals tend to average out to zero after integration. Secondly, because both the transmitted reference and message signals receive the same doppler shift (which may result from relative velocity between the transmitter and receiver), doppler will have no effort upon the operation of the system.

Another feature of the system which can be of great importance in some situations is that the system permits any sort of non-periodic energy such as might appear in nature to be used as the carrier, and there is no need to generate large amounts of periodic energy which is sometimes most difficult to accomplish, particularly at very high microwave frequencies.

Also, the use of a non-periodic signal, particularly one which is spread over a relatively wide band, is very difficult to jam because of the wide range of jamming frequencies which must be provided and the small possibility that they will be sufficiently correlated to affect system operation. Further, since the radiated signal appears as a continuous random signal, an unwanted listener who did not know the value of T could not interpret the radiated signal even if the principal of operation were understood.

In a typical operating system of FIG. 1 the value of T is chosen equal to 100 microseconds, "white" noise is used as the random signal obtained from the source 14, and the bandpass filter 16 is chosen to have a center frequency of 200 kilocycles and a bandwidth of 100 kilocycles. These values are only illustrative and should not be considered as limiting the scope of the invention.

It is to be understood in connection with the system described herein that the electronic circuitry and devices designated in block form in FIG. 1 are all of a type which can readily be provided by those skilled in the art. Since the present invention resides chiefly in the combination of these electronic devices and circuitry and not in the design of any particular one thereof, the details of these devices and circuitry will not be given. However, based upon the description and operation of the various systems provided herein, those skilled in the art will have no difficulty in practicing the invention.

It is also to be understood that the invention is not limited to the embodiments described and illustrated herein, since many modifications and variations in the construction and arrangement thereof may be made without departing from the scope of the invention as defined in the appended claims.

We claim as our invention:

1. A binary digital communication system comprising a transmitter and receiver: said transmitter comprising means for alternately radiating in response to the digits of a binary message two signals of non-periodic energy which have been delayed by a predetermined amount with respect to one another, and means for phase shifting one of said signals by 180° prior to radiation thereof in response to one of the "0" and "1" digits of the binary message; said receiver comprising means for receiving the signals alternately radiated by said transmitter, means for delaying the alternately received signals with respect to one another so they are brought back into correlation, and correlation-sensitive means to which the correlated received signals are fed, the output of said correlation-sensitive means being representative of said binary message.

2. A binary digital communication system comprising a transmitter and a receiver; said transmitter comprising means for obtaining two signals of non-periodic energy which have been delayed by a predetermined amount with respect to one another, means for alternately radiating the two signals to said receiver in response to the digits of a binary message, and means for phase shifting one of the two alternately radiated signals by 180° prior to radiation thereof in response to one of the "0" and "1" digits of the binary message; said receiver comprising means for receiving the signals alternately radiated by said transmitter, means for delaying the alternately received signals by a predetermined amount with respect to one another so that they are brought back into correlation, multiplier means for multiplying the two correlated signals together, and integrator means for integrating the output of said multiplier means, the output of said integrator means being representative of said binary message.

3. A binary digital communication system comprising a transmitter and a receiver; said transmitter comprising a source of non-periodic energy, means for deriving from said source two signals of non-periodic energy which have been delayed by a predetermined amount with respect to one another, means for converting a binary message into binary message pulses having a repetition rate equal to twice said predetermined amount, said pulses having one polarity for a "0" of the binary message and the opposite polarity for a "1" of the binary message, means for alternately radiating the two signals to said receiver in response to each binary message pulse for substantially equal periods of time, each period being substantially equal to said predetermined amount, and means for causing one of the alternately radiated signals to be shifted in phase by 180° prior to radiation thereof in response to the binary message pulses of one polarity; said receiver comprising means for receiving the signals alternately radiated by said transmitter, means for delaying the alternately received signals by a predetermined amount with respect to one another so that they are brought back into time coincidence, multiplier means for multiplying the two coincident signals together, and integrator means for integrating the output of said multiplier means, the output of said integrator means being representative of said binary message.

4. A binary digital communication system comprising a transmitter and receiver; said transmitter comprising a source of non-periodic energy, means for restricting said non-periodic energy to a predetermined band, means for dividing the restricted band non-periodic energy into first and second signals, a delay network providing a predetermined time delay to which said first signal is fed, means connected to the output of said delay network for producing two signals shifted in phase by 180° with respect to one another, electronic switching means to which the two 180° phase-shifted signals are fed, means for converting a binary message into binary message pulses having a repetition rate equal to twice said predetermined time delay, said pulses having one polarity for a "0" of the binary message and the opposite polarity for a "1" of the binary message, means cooperating with said electronic switching means and said binary message pulses so that said electronic switcing means passes one of the 180° phase-shifted signals in response to a binary message pulse of one polarity and the other of the 180° phase-shifted signals in response to a binary message pulse of the opposite polarity, a first gate to which the output of said electronic switching means is fed, a second gate to which the second signal obtained from dividing the restricted band non-periodic energy signal is fed, and means for opening the first and second gates in response to said binary message pulses so that the output signals therefrom are alternately radiated to the receiver; said receiver comprising antenna means for picking up the signals alternately radiated by said transmitter, amplification means to which the antenna means are connected, a multiplier having two inputs, delay means providing a delay substantially equal to said predetermined delay, means for feeding the output from said amplifier means directly to one of the inputs of said multiplier and to the other input of said multiplier through said delay means, and an integrator to which the output of said multiplier is fed, the output of said integrator having representative of said binary message.

5. A communication system for a binary message which message includes pulses representing "1" digits and "0" digits comprising a transmitter and a receiver; said transmitter comprising a source of non-periodic energy, means responsive to said energy source for deriving a signal which is delayed with respect to said energy source, means responsive to said delayed signal deriving means for effecting a phase shift of 180° in the output of said deriving means, means for radiating wide band energy, first means for gating a signal to said radiating means, means for selectively connecting either said delayed signal deriving means or said phase shift effecting means to said first gating means, second means for gating a signal to said radiating means, means connecting said energy source to said second gating means, means responsive to the binary message for producing a first gating signal having a duration substantially equal to one-half the period between adjacent digits and a second gating signal in sequence with said first gating signal and of substantially equal duration, and means connecting the binary message to said selective connecting means; and said receiver comprising means for picking up the radiated signal, means for delaying the output of said pick-up means by an amount of time equal to said delayed signal deriving means, means for multiplying the output of said pick-up means by the output of last said delay means, means for integrating the output of said multiplying means and means for producing a pulse only when the output of said integrating means exceeds a preselected level.

* * * * *